US012742583B2

(12) United States Patent
de Bie et al.

(10) Patent No.: US 12,742,583 B2
(45) Date of Patent: Sep. 22, 2026

(54) COOLED CONTAINER AND METHOD FOR DISTRIBUTING COOLED ITEMS

(71) Applicant: Meds2GO Holding B.V., The Hague (NL)

(72) Inventors: Michiel de Bie, The Hague (NL); Ronald Nanninga, The Hague (NL)

(73) Assignee: MEDSZGO Holding BV, The Hague (NL)

( * ) Notice: Subject to any disclaimer, the term of this patent is extended or adjusted under 35 U.S.C. 154(b) by 272 days.

(21) Appl. No.: 18/043,193

(22) PCT Filed: Aug. 20, 2021

(86) PCT No.: PCT/EP2021/073205
§ 371 (c)(1),
(2) Date: Feb. 27, 2023

(87) PCT Pub. No.: WO2022/048926
PCT Pub. Date: Mar. 10, 2022

(65) Prior Publication Data

US 2023/0324098 A1 Oct. 12, 2023

(30) Foreign Application Priority Data

Sep. 1, 2020 (EP) ..... 20193949

(51) Int. Cl.
*F25D 11/00* (2006.01)
*F25D 17/06* (2006.01)
*F25B 21/02* (2006.01)

(52) U.S. Cl.
CPC ..... *F25D 11/006* (2013.01); *F25D 11/003* (2013.01); *F25D 17/06* (2013.01); *F25B 21/02* (2013.01); *F25B 2400/24* (2013.01)

(58) Field of Classification Search
CPC ..... F25D 11/003; F25D 11/006; F25D 2303/083; F25D 2303/0831;
(Continued)

(56) References Cited

U.S. PATENT DOCUMENTS 6,082,114 A 7/2000 Leonoff
2017/0336134 A1 11/2017 Williams
(Continued)

FOREIGN PATENT DOCUMENTS

EP 3564602 A1 11/2019
JP 2002-228323 A 8/2002
WO 2015055836 A1 4/2015

OTHER PUBLICATIONS

International Search Report and Written Opinion for corresponding International application No. PCT/EP2021/073205; dated Nov. 16, 2021 (14 pages).

*Primary Examiner* — Joseph F Trpisovsky
(74) *Attorney, Agent, or Firm* — Mendelsohn Dunleavy, PC; Kevin J. Dunleavy

(57) ABSTRACT

A container (1) for holding and transporting cooled items, such as medicines. The container comprises an enclosure enclosed by a cooling element (8) containing a phase change material, a heat sink (11) outside the enclosure and a duct (12) forming a closed loop between the cooling element and the heat sink, for circulation of a coolant. The heat sink may for example comprise a Peltier element (14).

19 Claims, 7 Drawing Sheets

Figure 1:
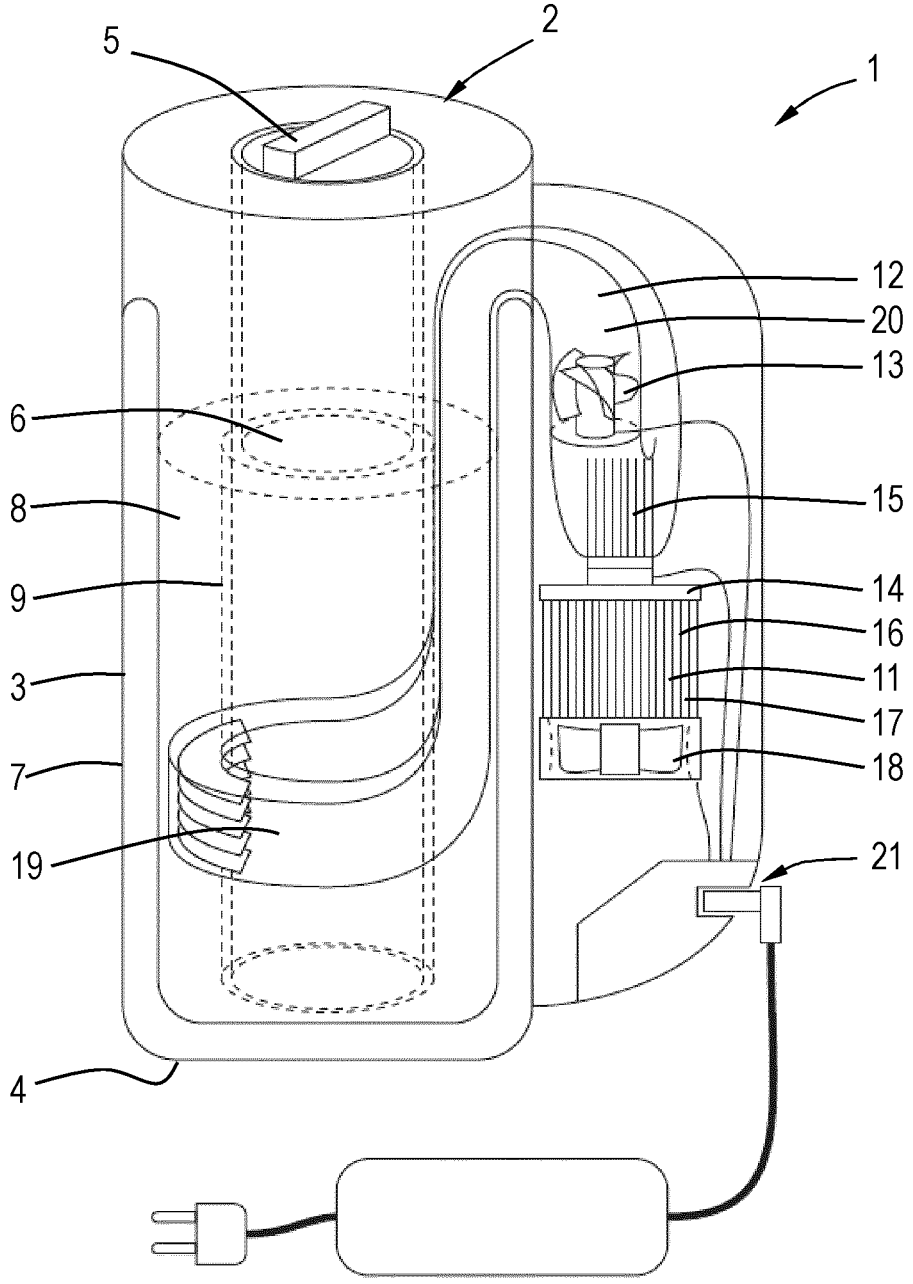

(58) Field of Classification Search
CPC ..... F25D 2303/084; F25D 2303/0841; F25D 15/00; F25B 21/02; F25B 2321/02; F25B 2321/023; F25B 2321/025; F25B 2321/0251
See application file for complete search history.

(56) References Cited

U.S. PATENT DOCUMENTS

| | | | | |
|---|---|---|---|---|
| 2018/0171197 | A1* | 6/2018 | Ma | F28D 20/021 |
| 2018/0266739 | A1* | 9/2018 | Godbole | F28F 3/12 |
| 2020/0056828 | A1* | 2/2020 | Kim | F25D 17/062 |

* cited by examiner

COOLED CONTAINER AND METHOD FOR DISTRIBUTING COOLED ITEMS

The invention relates to a cooled container and to a method of distributing cooled items, in particular medicines. The medicines are stored and cooled in a distribution center and subsequently shipped to a delivery address in a cooled container.

Hitherto, medicines requiring cooled transport are shipped in an isolated container or box with one or more cooling element containing a refrigerant. An example of such a container is disclosed in EP 3564602, using phase change materials to cool contained medicines. Such cooled boxes stay sufficiently cool for about 8 hours. However, the temperature may not be very constant during that time. Moreover, many delivery addresses are remote from any distribution center and may require a longer transport time. After delivery the cooled container is returned. Before the container can be used again, the cooling element must be cooled down again in a freezer. This requires accurate logistic planning. Another drawback of existing systems is that ambient moisture tends to condensate on the cooling element, when the phase change material is being reconditioned.

WO 2015/055836 discloses a portable container with phase change material supported, a Peltier element cooling the enclosure and a second Peltier element for cooling the phase change material, both powered by a rechargeable battery. This system is rather complex and needs to be powered during transport by a rechargeable battery.

Hence, there is a need for a cooled container allowing longer and more efficient cooling and re-cooling.

The object of the invention is achieved with a container for holding and transporting cooled items, such as medicines, the container comprising an enclosure at least partly enclosed by a cooling element containing a phase change material. The container comprises a heat sink outside the enclosure and a duct forming a closed loop between the cooling element and the heat sink, for circulation of a coolant, such as air.

By circulating the coolant between the phase change material and the exterior heat sink, e.g., by means of a pump, a fan or a similar drive, the phase change material is cooled. After actively cooling the phase change material by circulation of the coolant, the phase change material can passively keep the enclosure at the desired temperature for a significantly longer time.

To provide active cooling of the coolant the heat sink may for example comprise a thermoelectric element, such as a Peltier element, with a cold side in the duct and a warm side outside the duct. The warm side of the thermoelectric element comprises cooling fins and a fan.

To distribute the cooling evenly over the phase change material and evenly within the enclosure, the cooling element may further comprise a thermal spreader in thermo-conductive contact with the phase change material, such as a metal liner of the enclosure. Optionally, the heat spreader is provided with fins extending into the coolant duct. This helps to significantly reduce the time for cooling and solidifying the phase change material. It has been found that very fast cooling times can be obtained, allowing the PCM to re-solidify in two hours or less. Very cold coolant can be used without the risk that the temperature within the enclosure would drop below 0° C., which would be detrimental for most medicines.

In a specific embodiment, the duct comprises a section between the thermal spreader and the phase change material.

For example, the duct may comprise a section embedded in the phase change material and in thermo-conductive contact with the thermal spreader forming the liner of the enclosure. When the container is actively cooled, the coolant is cooled by the thermoelectric element, flows through the duct and cools the phase change material. Phase change material not in direct contact with the duct is cooled via the liner.

In use, heat enters the container where the thermal resistance is lowest, usually at the cap. Due to the spreader, the temperature in the enclosure remains essentially equal, notwithstanding such thermal leaks.

The container will typically comprise a lid and an open side with an opening giving access to the enclosure, the opening being closed or closeable by the lid. To allow even cooling the cooling element comprising the phase change material may fully surround the enclosure, except for the access opening which may be closed off by the lid, e.g., a thermally insulating lid, optionally also containing a phase change material.

The duct loops between the internal phase change material and the exterior heat sink. Hence, the duct has an interior part within the container and an exterior part outside the container. To optimize heat transfer with the phase change material, the interior part of the duct can for example at least partly embedded in the phase change material.

Further improvement of heat transfer can be obtained by cooling fins within the duct in thermo-conductive contact with the spreader and optionally also with the phase change material. The cooling fins can be an integral part of the spreader. Such fins are particularly useful if the coolant is air.

The container can for example comprise a double walled outer flask, e.g., a vacuum flask.

The container can be provided with a display surface configured to show shipment information, such as names and addresses, e.g., on removable labels, the display surface being visible at least when the container is connected to the charger, but preferably also when the connecter is not connected to the charger. Optionally, the display can also show battery status and/or the temperature within the enclosure, e.g., with warning signs if the temperature is below or above a set value.

Suitable phase change materials include salt hydrates, ionic liquids, fatty acids and esters, and various liquid alkanes or paraffins, such as octadecane and tetradecane. Particularly suitable are phase change materials having a melting temperature below 10° C., e.g., at about 5° C. or lower, such as for example Crodatherm® 5 of Croda, savE OM 05 of Pluss, 0200-Q5 BioPCM of Phase Change Energy Solutions, or RT5 or RT5 HC of Rubitherm. Water-based phase change materials can also be used, e.g., a mixture of water with glycerol.

The coolant can be any suitable gas or liquid, such as air or water.

The thermoelectric element can be powered by means of a battery or by connecting it to an external power source, in particular the mains. For transport from a distribution center to a delivery address, it is sufficient to power the thermoelectric element in the distribution center before the transport without further active cooling during transport.

The invention makes it possible to distribute heat sensitive items, in particular medicines, from a distribution center to a delivery address by a process containing the following steps:

providing a container comprising an interior enclosed by a cooling element comprising phase change materials;

subsequently cooling the container;

subsequently adding the heat sensitive items to be transported;

subsequently transporting the items in the container to the delivery address.

Hence, the containers are cooled centrally, e.g., within the distribution center without removing the cooling elements with the phase change material from the containers.

Optionally, the distribution center can be provided with a charger for simultaneously cooling a plurality of the containers. The charger may for example comprise a plurality of connection points, each being configured to connect to one of the containers for power supply to the thermoelectric element. The connection points may be shaped to receive or support the containers during connection.

The invention also relates to the charger for use with the disclosed method. The charger may for example comprise an essentially vertical front side presenting an array of said connection points, preferably at a height which is easy accessible for a standing user of average height.

Optionally, the container and the recess are shaped to allow only receipt of the container in the recess with only one single position of the container. This helps to ensure that the containers make a proper charging contact with the connection points of the charger. In order to prevent unintentional removal of the containers, the recess may be adapted to receive the container with a releasable connection, e.g. a releasable snap connection.

Optionally, transport takes place with vehicles comprising a charger, in particular a power charger, with one or more connection points for re-charging containers during transport.

The distribution center is typically a ware house or fulfilment center provided with storage facilities, e.g., cooled or air conditioned cooling facilities or rooms for temporary storing the products, optionally package handling equipment, such as sorters and conveyers, and optionally one or more loading bays for trucks or vans or similar vehicles for transportation.

The method can be used for distribution of any type of heat sensitive product requiring cooled storage. The method is particularly suitable for shipping medicines, in particular biologicals extracted from living tissues, insulin or vaccines, in particular to end users.

The invention is further explained with reference to the accompanying drawings showing exemplary embodiments.

Figure 2:
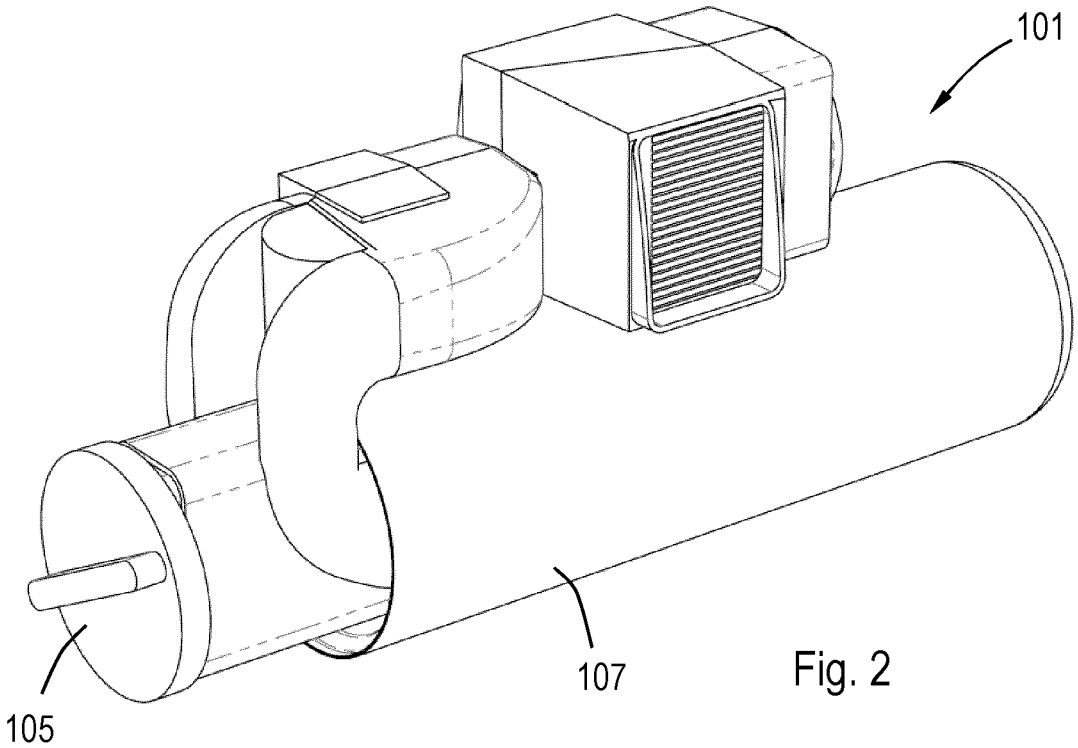
Figure 3:
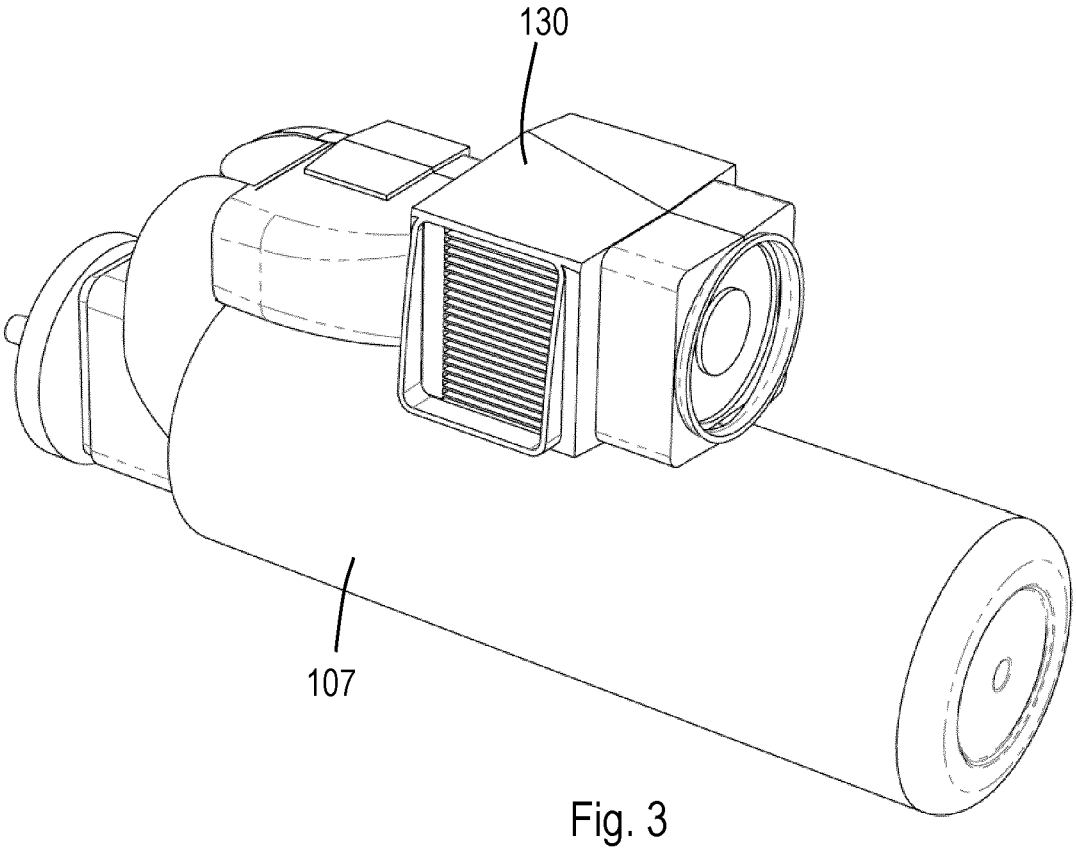
Figure 4:
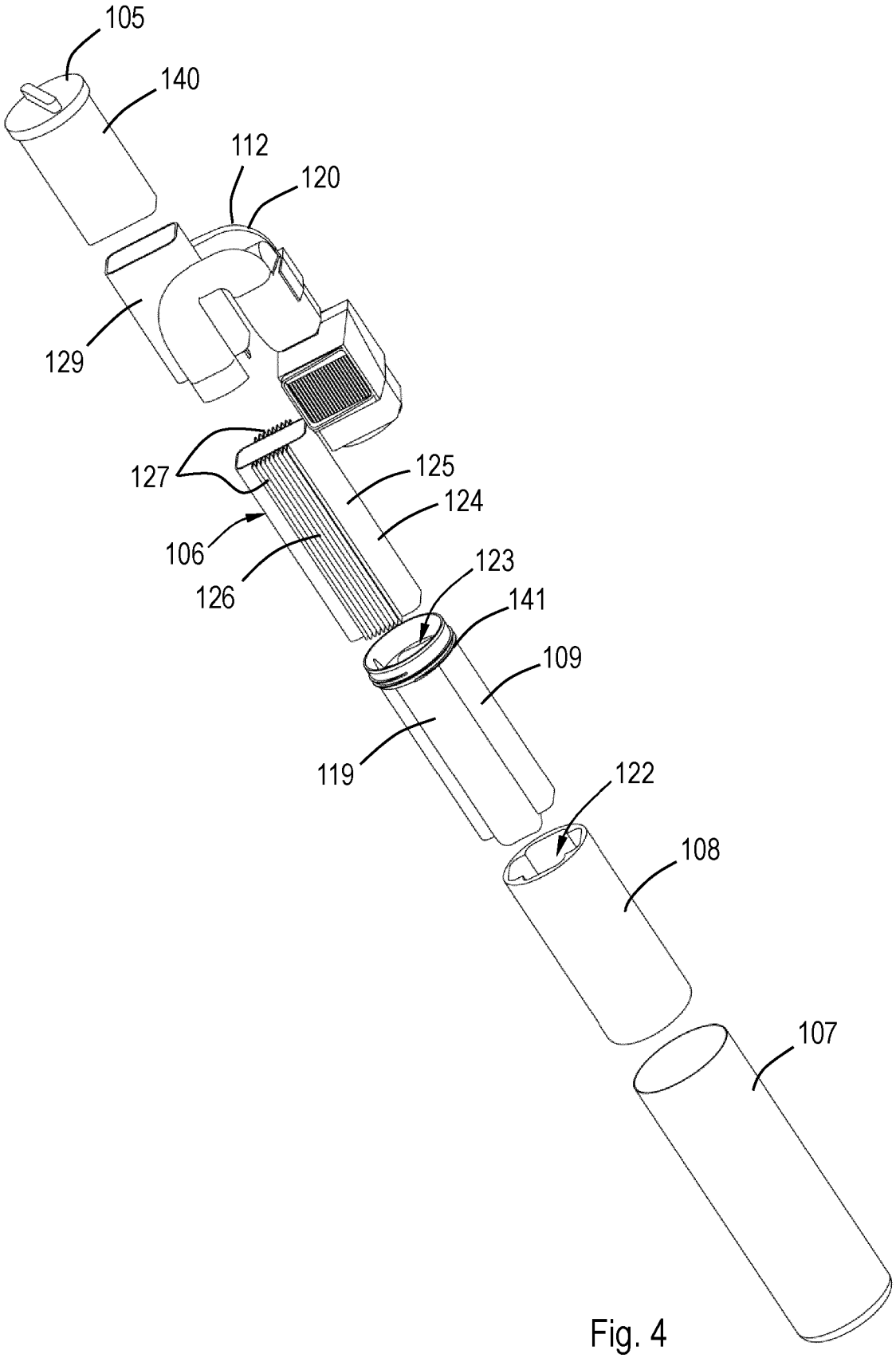
Figure 5:
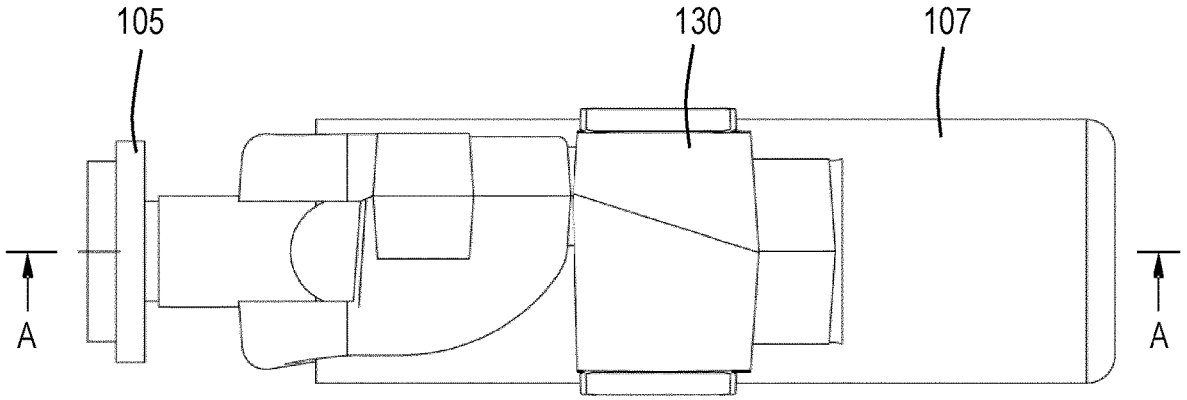
Figure 6:
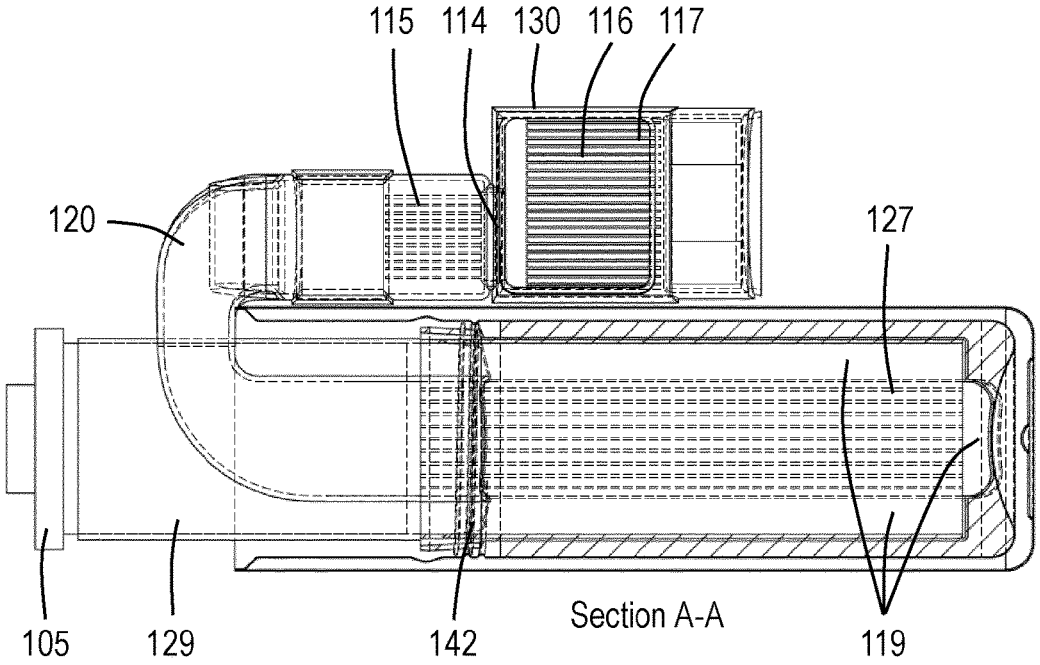
Figure 7:
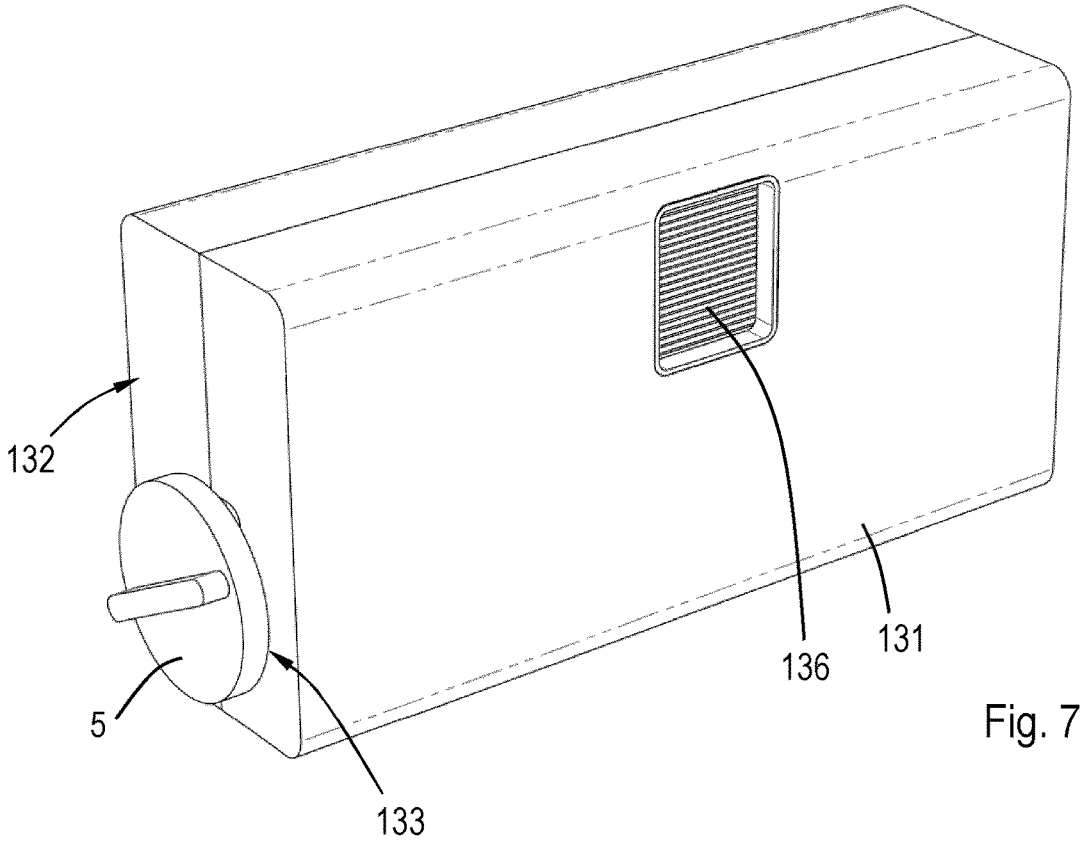
Figure 8:
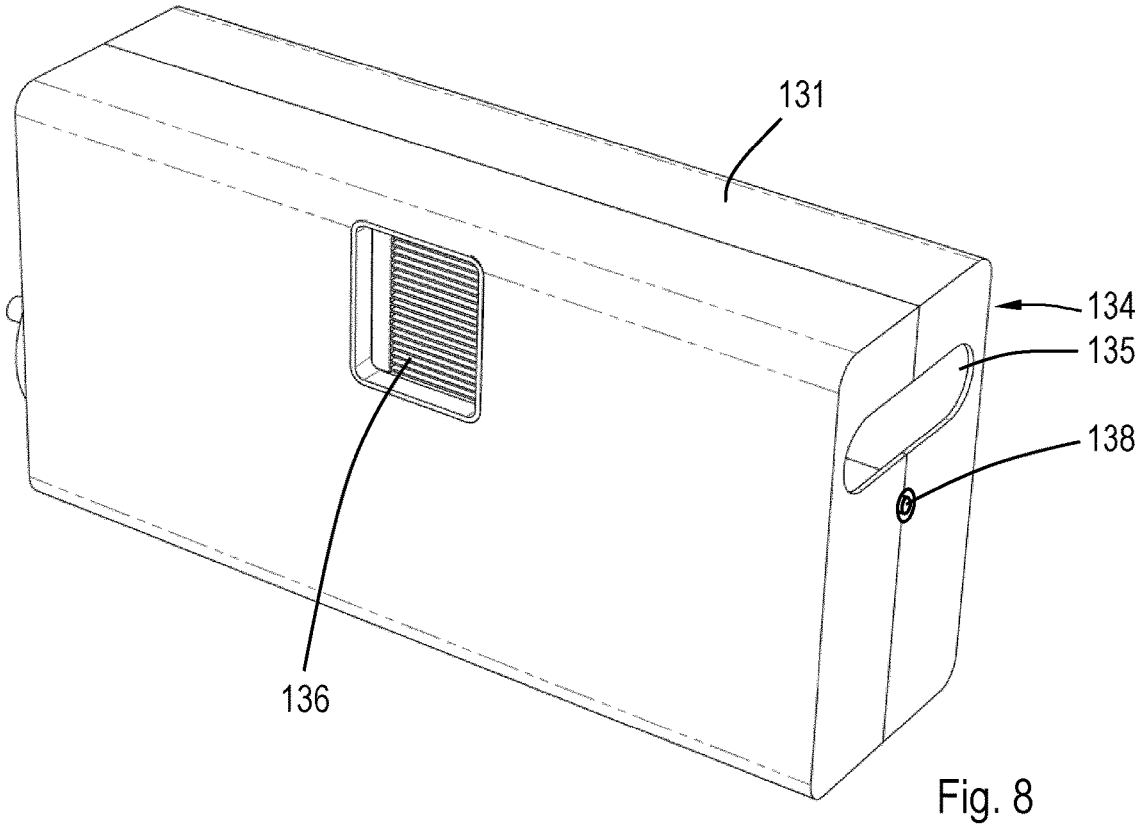
Figure 9:
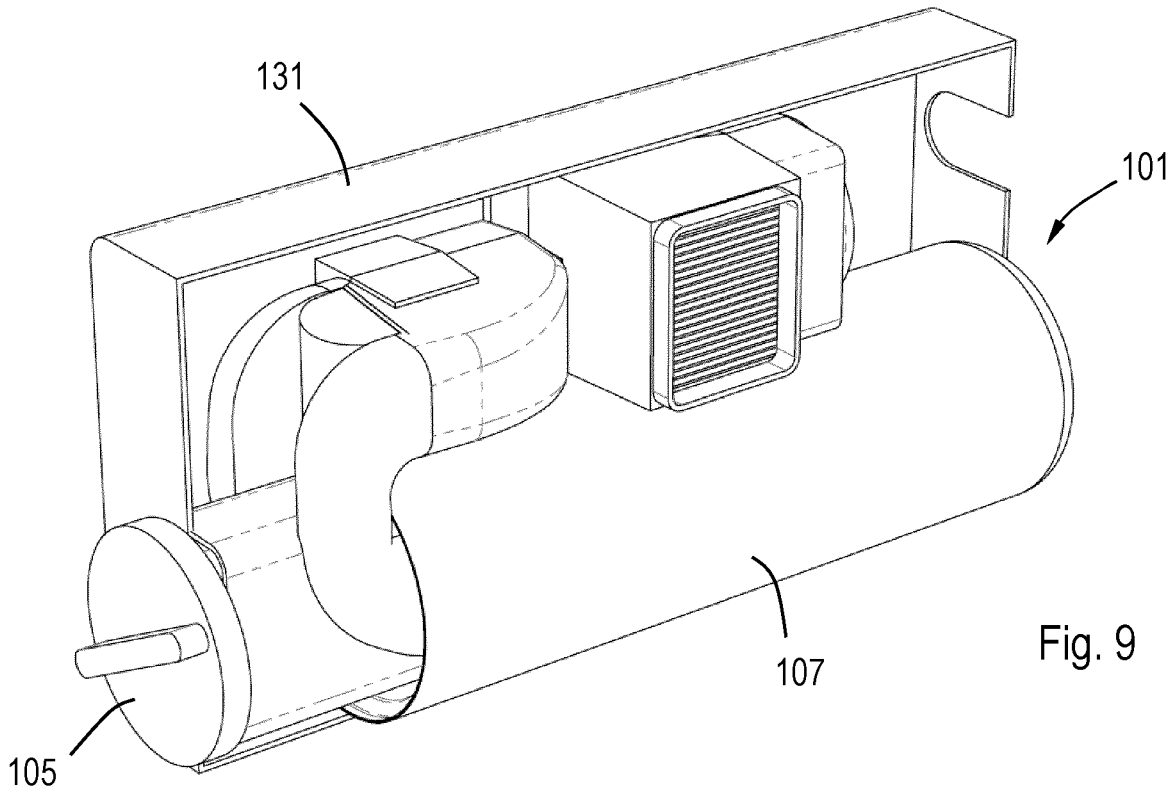
Figure 10:
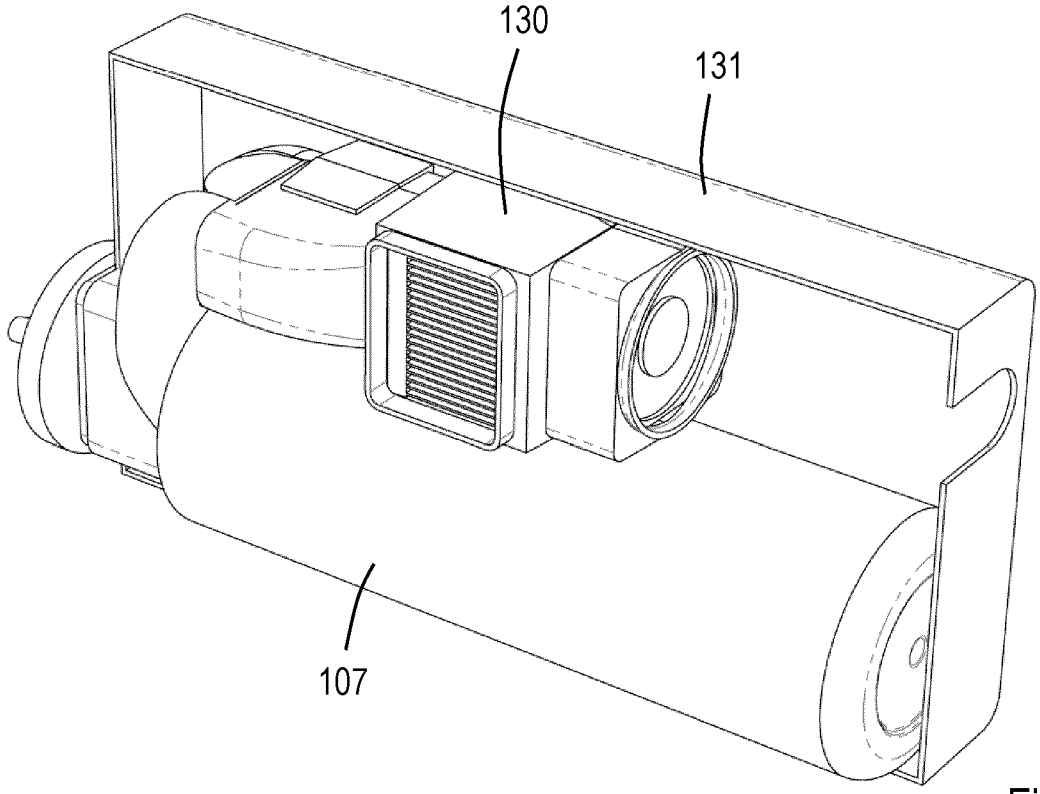
Figure 11:
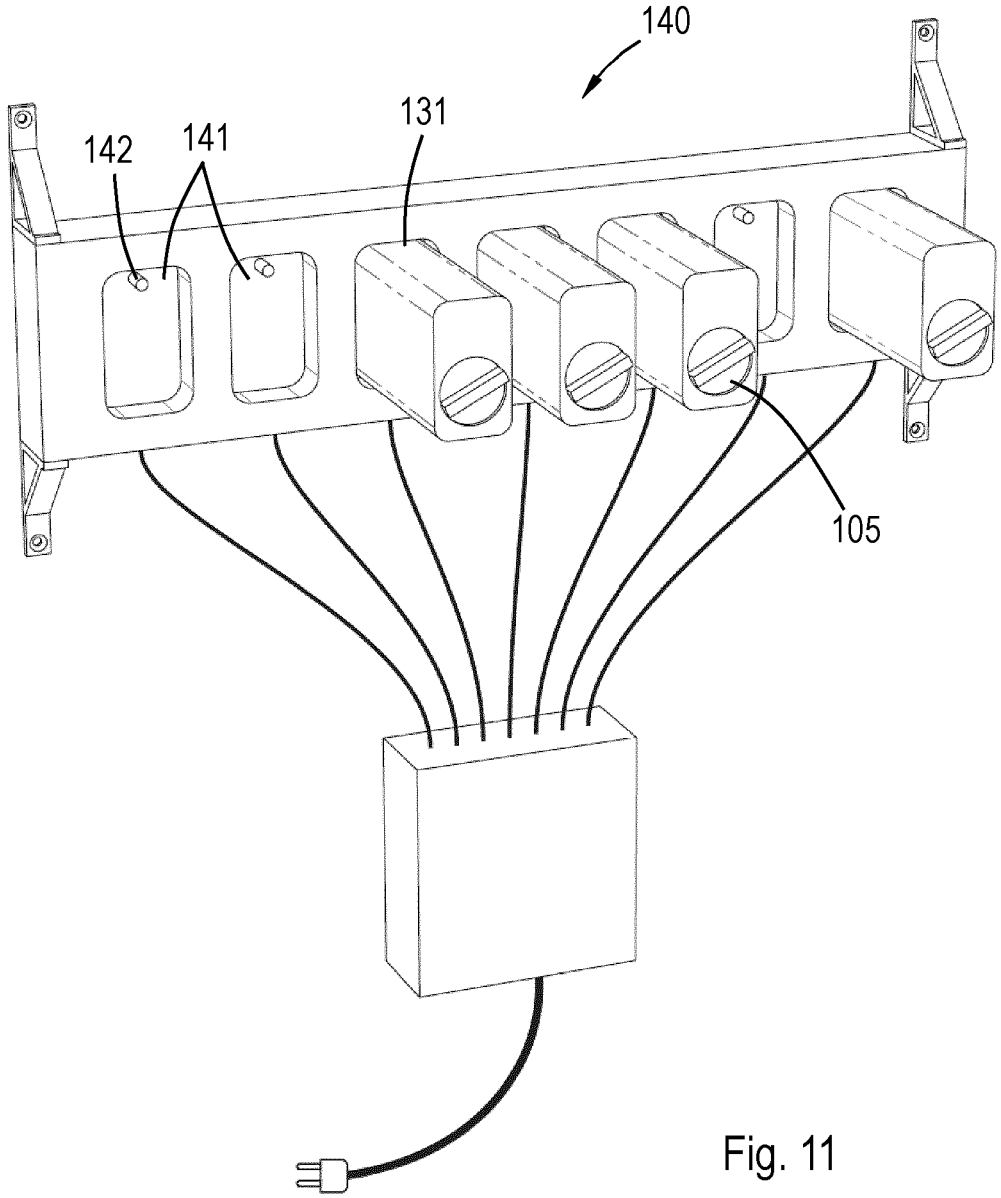

FIG. 1: shows schematically a container according to the invention;

FIG. 2: shows a second exemplary embodiment of a the container in perspective view FIG. 3: shows the container of FIG. 2 from a different viewing angle;

FIG. 4: shows the container of FIG. 2 in exploded view;

FIG. 5: shows the container of FIG. 2 in side view;

FIG. 6: shows a cross section along line A-A in FIG. 5;

FIG. 7: shows a casing of the container of FIG. 2 in perspective view;

FIG. 8: shows the casing of FIG. 7 at a different viewing angle;

FIG. 9: shows the container of FIG. 2 in the casing of FIG. 7, the casing being partly removed casing from a first viewing angle;

FIG. 10: shows the assembly of FIG. 9 from a second viewing angle;

FIG. 11: shows a wall charger with containers.

FIG. 1 shows an exemplary embodiment of a container 1 for holding and transporting heat sensitive items, in particular medicines. In the shown embodiment, the container 1 is cylindrical but it can also be box-shaped or it may have any other suitable configuration.

The container 1 has an open top end 2, a closed outer wall 3 and bottom 4, and a lid 5 of an insulative material for closing off the open end 2. The open end 2 defines an opening allowing access to an enclosure 6 or chamber for storing the heat sensitive items.

The container 1 comprises an outer double walled, vacuum flask 7, defining the outer wall 3 and the bottom 4, and a tubular cooling element 8 fitting within the flask 7 and fully surrounding the enclosure 6, including the bottom part of the enclosure, except for the access opening 2.

The tubular cooling element 8 holds a phase change material in a thin-walled foil allowing optimum heat transfer. The cooling element 8 has an inner wall defining the enclosure 6. The inner wall is lined with a thermal heat spreader 9 of a metal or similarly heat conductive material.

The container 1 comprises a heat sink 11 outside the enclosure 6 and outside the flask 7. An air duct 12 forms a closed loop between the cooling element 8 and the heat sink 11 and comprises a first fan 13 for circulating the air through the duct 12. The heat sink 11 comprises a Peltier element 14, with a cold side 15 in the air duct 12 and a warm side 16 outside the air duct 12. The warm side 16 of the Peltier element 14 comprises cooling fins 17 and a second fan 18.

The air duct 12 has an interior part 19 embedded in the phase change material and an exterior part 20 comprising the cold side 15 of the Peltier element 14. This interior part 19 of the air duct 12 is in intimate heat conductive contact with the surrounding phase change material and with the thermal spreader 9.

The container 1 has a power connection port 21. Powering the container 1 will activate the first fan 13 in the air duct 12 and the Peltier element 14. Air in the air duct 12 is circulated. When it passes the cold side 15 of the Peltier element 14 in the air duct 12, heat is extracted from the air and dissipated to via the warm side 16 of the Peltier element 14. To promote heat dissipation the warm side 16 of the Peltier element 14 is provided with the fins 17 and the second fan 18 blowing outside air through the fins 17.

After passing the Peltier element 14, the cooled air flows back to the interior part 19 of the air duct 12 where it extracts heat from the phase change material. The thermal spreader 9 helps to cool the phase change material more evenly.

A second exemplary embodiment of a container 101 according to the invention is shown in FIGS. 2-6. This container comprises a cylindrical double walled vacuum flask 107 and a cooling element 108 of a phase change material tightly fitting within the flask 107 (FIG. 4). The cooling element 108 has an internal cavity 122 which is cross shaped in cross section and in top view. A liner 109 maintains the phase change material in the desired shape. The liner 109 has a closed bottom, an open top end and a cross shaped interior space 123. A rectangular heat spreader 124 is received within the cross shaped interior space 123 of the liner 109. In top view, the heat spreader 124 has two opposite ends 125, 126 received in two opposite ends of the cross shaped cavity 123 of the liner 109, and two oppositely arranged sets of cooling fins 127 received in the other two ends of the cross shaped interior space 123 of the liner 109. At the bottom side of the heat spreader 124, the cooling fins 127 space the heat spreader 124 from the closed bottom of the liner 109. The inner side of the heat spreader 124 defines an enclosure 106 for receiving heat sensitive products, in particular medicines. The sections of the liner 109 receiving the cooling fins 127 of the heat spreader 124 form an interior section 119 of an air duct 112.

The container 101 further comprises an exterior section 120 of the air duct 112. The interior and exterior sections 119, 120 of the air duct form a closed loop passing a Peltier element 114 (FIG. 6) with a cold side 115 inside the air duct 112 and a warm side 116 outside the air duct 112. Fans (not shown) serve to circulate air within the closed air duct 112 and outside air along cooling fins 117 of the warm side 116 of the Peltier element 114. The cooling fins 117 are encased in a housing 130 with open side walls defining a flow path for air along the cooling fins 117.

The exterior section 120 of the air duct is supported by a rectangular tube 129 in line with the heat spreader 124. This rectangular tube 129 receives a matching skirt 140 of the lid 105. The flask 107 has an internal screw thread 142 cooperating with an external screw thread 141 at the top of the liner 109.

The container 101 fits within a protective casing 131, shown in FIGS. 7 and 8. The casing 131 has a top end 132 with an opening 133 exposing the lid 105 of the container 101, and a bottom end 134 with an opening 135 to allow suction of air to the cooling fins 117, and an opening 138 allowing access to a power connection element of the container 101. Two opposite side walls are provided with openings 136 connecting to the open side walls of the housing 130 encasing the cooling fins 117 of the Peltier element 114.

The container 1, 101 serves to transport medicines from a distribution center to a delivery address, in particular of an end user. After delivery of the medicines, the container 1, 101 is returned to the same distribution center, or to a similar distribution center. The distribution center is provided with a charger for charging a plurality of transport containers 1, 101. The charger can be configured to charge the containers 1, 101 with electricity to power the Peltier elements 14, 114.

A wall mountable exemplary embodiment of such a charger is shown in FIG. 11. The charger 140 has a series of connection points 141 with connector elements 142. The connection points 141 of the charger 140 are shaped and dimensioned such that the containers 1, 101 can easily be clicked into the respective connection points 141 of the charger 140, such that the connector element 142 of the charger 140 engages the power connection element of the container 1, 101 to allow powering of the Peltier elements 14, 114 and the fans for circulating air through the air ducts 12, 112.

The charger 140 and/or the container 1, 101 can be provided with a power management system, which may for instance comprise thermo-sensors in the enclosure 6 of the container 1 and a controller configured to switch off power feed to the container when the temperature in the enclosure 6, 106 is at a desired level.

To prepare the container 1, 101 for a next shipment, the container 1, 101 is coupled to the charger 140 for cooling. An operator selects a sufficiently cooled container for a scheduled shipment, detaches the container 1, 101 from the charger 140 and opens the cooled enclosure of the container to place the medicines in it. The container is then closed. The container 1, 101 is labeled with a delivery address and shipped by means of a vehicle such as a van. Optionally, this vehicle may also be provided with a charger 140 for cooling the container 1, 101 but for most distances this should not be necessary within normal outside temperature windows.

After delivery of the medicines, the container 1 is returned to the distribution center, where it can be cooled again on the charger 140 for a next shipment.

The invention claimed is:

1. A container for holding and transporting cooled items, the container comprising an enclosure at least partly enclosed by a cooling element containing a phase change material, a heat sink outside the enclosure, and a duct for circulation of coolant forming a closed loop between the cooling element and the heat sink, wherein the cooling element further comprises a thermal spreader in thermo-conductive contact with the phase change material, and the duct comprises a section extending between the thermal spreader and the phase change material.

2. The container of claim 1, wherein the duct comprises a drive for circulating the coolant through the duct.

3. The container of claim 1, wherein the heat sink comprises a thermoelectric element with a cold side in the duct and a warm side outside the duct.

4. The container of claim 3, wherein the warm side of the thermoelectric element comprises cooling fins and a fan.

5. The container of claim 1, wherein the thermal spreader comprises a metal liner of the enclosure.

6. The container of claim 1, wherein the cooling element containing the phase change material fully surrounds the enclosure, jointly with a thermally insulating lid.

7. The container according to claim 1, wherein the duct has a part within the container which is at least partly embedded in the phase change material.

8. The container according to claim 1, wherein the duct contains cooling fins in thermo-conductive contact with the phase change material.

9. The container according to claim 1, wherein the coolant is air.

10. A method for distributing heat sensitive items from a distribution center to a delivery address comprising steps of:

providing a container according to claim 1;

subsequently cooling the container;

subsequently adding the heat sensitive items to be distributed; and subsequently transporting the heat sensitive items in the container to the delivery address.

11. The method of claim 10, wherein the distribution center is provided with a charger for cooling the container.

12. The method of claim 11 wherein the charger comprises a plurality of connection points, each being configured to receive and charge one said container.

13. The method of claim 12, wherein the container comprises one or more thermo-electric cooling elements;

the charger is a power charger, the connection points having electric contacts configured to mate with complementary contacts of the container for powering the thermo-electric cooling elements.

14. A charger for use in the method according to claim 13, the charger comprising an essentially vertical front side presenting an array of connection points.

15. The charger according to claim 14, wherein the connection points are shaped to receive or support one of said containers to establish a powering contact.

16. The charger according to claim 15, wherein the container and the connection points are shaped to allow connection of the container in only one single position.

17. The charger according to claim 16, wherein the container and connection points form a releasable snap connection for connecting the container and the charger.

18. The container of claim 2, wherein the drive is selected from the group consisting of a pump and a fan.

19. The container of claim 3, wherein the thermoelectric element is a Peltier element.

* * * * *